US007626473B2

(12) United States Patent
Kim et al.

(10) Patent No.: US 7,626,473 B2
(45) Date of Patent: Dec. 1, 2009

(54) SIGNAL TRANSMISSION LINE FOR MILLIMETER-WAVE BAND

(75) Inventors: Ho Young Kim, Daejeon (KR); Hae Cheon Kim, Daejeon (KR); Hyun Kyu Yu, Daejeon (KR); Young Jun Chong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 11/872,026

(22) Filed: Oct. 14, 2007

(65) Prior Publication Data

US 2008/0136566 A1 Jun. 12, 2008

(30) Foreign Application Priority Data

Dec. 7, 2006 (KR) ..... 10-2006-0123892

(51) Int. Cl.
*H01P 5/02* (2006.01)
*H01P 3/08* (2006.01)

(52) U.S. Cl. ..... 333/33; 333/128; 333/246

(58) Field of Classification Search ..... 333/128, 333/136, 33, 246, 260
See application file for complete search history.

(56) References Cited

U.S. PATENT DOCUMENTS 5,583,468 A * 12/1996 Kielmeyer et al. ..... 333/33
5,634,208 A 5/1997 Nishikawa et al.
5,942,957 A * 8/1999 Mohwinkel et al. ..... 333/128
6,023,080 A * 2/2000 Kojima ..... 257/275

FOREIGN PATENT DOCUMENTS

| | | |
|---|---|---|
| JP | 2000-106501 | 4/2000 |
| JP | 2001-036309 | 2/2001 |
| JP | 2001-068506 | 3/2001 |
| JP | 2003-209414 | 7/2003 |
| KR | 10-1999-0031577 | 5/1999 |
| KR | 100233084 B1 | 9/1999 |
| KR | 10-2004-0073131 A | 8/2004 |

OTHER PUBLICATIONS

Scardelleti et al., "Miniaturized Wilkinson Power Dividers Utilizing Capacitive Loading," *IEEE Microwave and Wireless Components Letters* 12:6-8 (2002).

* cited by examiner

*Primary Examiner*—Benny Lee

(57) ABSTRACT

Provided is a signal transmission line for a millimeter-wave band. The signal transmission line includes: a dielectric substrate; an input line formed on the dielectric substrate; a pair of serial transmission lines formed on the dielectric substrate, the serial transmission lines being branched at, separated from, and electromagnetically connected in series with one end of the input line; a pair of parallel transmission lines respectively formed on the dielectric substrate at both sides of the input line and the serial transmission lines, and having both ends separated from and electromagnetically connected in parallel with one end of each of the input line and the serial transmission lines; and a pair of wires electrically connected between the other ends of the parallel transmission lines and a connection pad of a monolithic microwave integrated circuit (MMIC). An electrical signal of about 57 to 63 GHz generated from a monolithic microwave integrated circuit (MMIC) can be efficiently transferred.

11 Claims, 3 Drawing Sheets

SIGNAL TRANSMISSION LINE FOR MILLIMETER-WAVE BAND

CROSS-REFERENCE TO RELATED APPLICATION

This application claims priority to and the benefit of Korean Patent Application No. 2006-123892, filed Dec. 7, 2006, the disclosure of which is incorporated herein by reference in its entirety.

BACKGROUND

1. Field of the Invention

The present invention relates to a signal transmission line for a millimeter-wave band, and more particularly, to a signal transmission line for a millimeter-wave band in a metal thin film form, which is capable of efficiently transferring an electrical signal of about 57 to 63 GHz generated from a monolithic microwave integrated circuit (MMIC) mounted on a dielectric substrate.

This work was supported by the IT R&D program of MIC (Ministry of Information and Communication)/IITA (Institute for Information Technology Advancement) [2005-S-039-02, SoP (System on Pakage) for 60 GHz Pico cell Communication] in Korea.

2. Discussion of Related Art

FIG. 1 is a perspective view illustrating a conventional signal transmission line for a millimeter-wave band, and FIG. 2 is a graph showing frequency-dependent reflection and transmission characteristics of FIG. 1.

Referring to FIG. 1, the conventional signal transmission line for a millimeter-wave band in a metal thin film form includes a transmission line 4 formed on a dielectric substrate 2. The transmission line 4 has a single metal surface and is in the form of a waveguide. The transmission line 4 is connected to a connection pad 3*a* of a monolithic microwave integrated circuit (MMIC) 3 mounted on the dielectric substrate 2, via one wire 1.

The signal transmission line has an excellent low-frequency characteristic. The signal transmission line, however, has a poor resistance characteristic at a frequency of about 10 GHz or more because of its parasitic capacitance and parasitic inductance components, resulting in a poor transmission characteristic as in FIG. 2. FIG. 2 shows the transmission characteristic that moves away from 0 dB and the reflection characteristic that moves toward 0 dB as the signal frequency increases. The ideal transmission characteristic of a transmission is 0 dB, i.e., the output signal is the same as the input signal. On the other hand, the reflection characteristic refers to a ratio of an input signal over a reflected signal and is considered poor if it approaches 0 dB.

To solve this problem associated with the signal transmission line in a simple metal thin film form, a Wilkinson power divider which has two transformer lines for signal transmission is used.

The Wilkinson power divider divides one input power into two output powers. The Wilkinson power divider includes a concentration element and a distribution element. Recent increases of radio communication frequencies require that the elements and accordingly the power divider are small.

FIG. 3 is a circuit diagram illustrating a structure of a typical Wilkinson power divider. Referring to FIG. 3, the Wilkinson power divider includes an input line 10 having an impedance value of 50Ω, transformer lines 20 branched into two transformer lines from the input line 10 and having an impedance value of 70.7Ω, and output lines 30 having an impedance value of 50Ω and respectively connected to ends of the transformer lines 20.

The Wilkinson power divider further includes an isolation resistor 40 of 100Ω connected between the output lines 30. This isolation resistor 40 serves to improve isolation between the output terminals. The respective lines 10, 20 and 30 are formed of a material having an excellent conductivity. Generally, the isolation resistor 40 is a chip resistor or a thin film resistor.

Parasitic components, such as parasitic capacitance and parasitic inductance, are inevitably created when the isolation resistor 40 is connected between the output lines 30. The parasitic components are created irrespective of a manufacturer's intention. Such parasitic components greatly degrade performance of the power divider as an operation frequency increases.

SUMMARY OF THE INVENTION

The present invention is directed to a signal transmission line for a millimeter-wave band that uses a structure of a typical Wilkinson power divider and has a pair of serial or parallel separated transmission lines, creating a combination of serial or parallel compensation capacitances and inductances for effectively canceling unnecessary parasitic components.

Also, the present invention is directed to a signal transmission line for a millimeter-wave band that includes dual wires connected to a monolithic microwave integrated circuit (MMIC) for effectively canceling parasitic inductance and parasitic capacitance inevitably created from one of the wires.

Also, the present invention is directed to a signal transmission line for a millimeter-wave band that prevents performance of a power divider from being degraded due to parasitic components such as parasitic inductance and parasitic capacitance in a conventional Wilkinson power divider, and that has an excellent transfer characteristic at a specific frequency (about 57 to 65 GHz).

One aspect of the present invention provides a signal transmission line for a millimeter-wave band, comprising: a dielectric substrate; an input line formed on the dielectric substrate; a pair of serial transmission lines formed on the dielectric substrate, the serial transmission lines being branched at, separated from, and electromagnetically connected in series with one end of the input line; a pair of parallel transmission lines respectively formed on the dielectric substrate at both sides of the input line and the serial transmission lines, and having both ends separated from and electromagnetically connected in parallel with one end of each of the input line and the serial transmission lines; and a pair of wires electrically connected between the other ends of the parallel transmission lines and a connection pad of a monolithic microwave integrated circuit (MMIC).

The dielectric substrate may be formed of at least one of a ceramic material, a dielectric material, a magnetic material, and a semiconductor material.

The serial transmission lines may be collinear with the input line, and may be spaced apart from and parallel to each other.

The parallel transmission lines may be separated from and parallel to the input line and the serial transmission lines.

The serial transmission lines and the parallel transmission lines may differ in width and length.

The input line, the serial transmission lines, and the parallel transmission lines may be in the form of a waveguide having a single metal surface.

The input line, the serial transmission lines, and the parallel transmission lines may have impedance values of 50Ω, 70Ω, and 100Ω, respectively.

According to the present invention, the signal transmission line in a metal thin film form is designed and manufactured in a Wilkinson power divider structure of a parallel dual waveguide type in order to efficiently transfer an electrical signal to a monolithic microwave integrated circuit (MMIC) mounted on a dielectric substrate, e.g., a Low Temperature Co-fired Ceramic (LTCC) substrate. Thus, the signal transmission line has an excellent transfer characteristic at very high frequencies in a millimeter-wave band (about 57 to 65 GHz).

A resistance characteristic of the transmission line must be suitable for a transferred frequency in order to transfer an electrical signal to the MMIC mounted on the LTCC substrate. In the present invention, the signal transmission line is implemented using a dual structure of a Wilkinson power divider to obtain a resistance characteristic suitable for a very high frequency.

BRIEF DESCRIPTION OF THE DRAWINGS

The above and other objects, features and advantages of the present invention will become more apparent to those of ordinary skill in the art by describing in detail preferred embodiments thereof with reference to the attached drawings, in which.

DETAILED DESCRIPTION OF EXEMPLARY EMBODIMENTS

Hereinafter, exemplary embodiments of the present invention will be described in detail. However, the present invention is not limited to the exemplary embodiments disclosed below, but can be implemented in various types. Therefore, the present exemplary embodiments are provided for complete disclosure of the present invention and to fully inform the scope of the present invention to those ordinarily skilled in the art.

Figure 1:
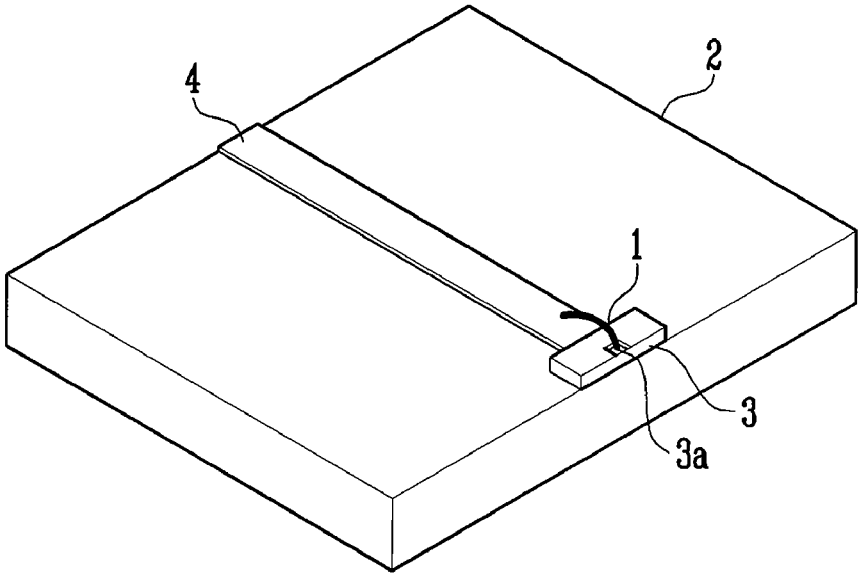
FIG. 1 (PRIOR ART)
FIG. 1 is a perspective view illustrating a conventional signal transmission line for a millimeter-wave band.
Figure 2:
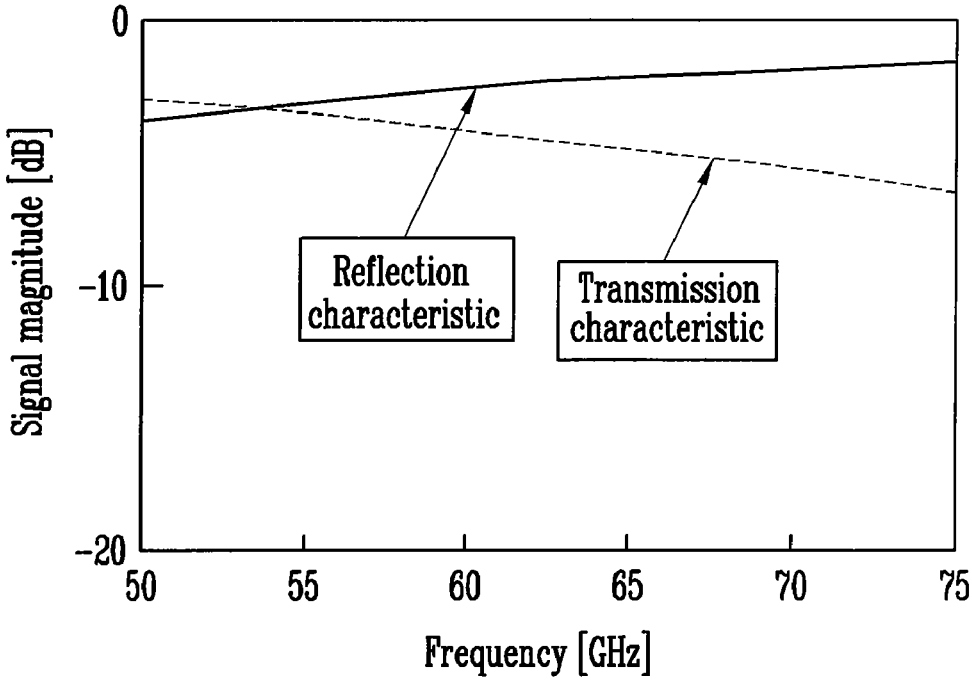
FIG. 2 (PRIOR ART)
FIG. 2 is a graph showing frequency-dependent reflection and transmission characteristics of FIG. 1.
Figure 3:
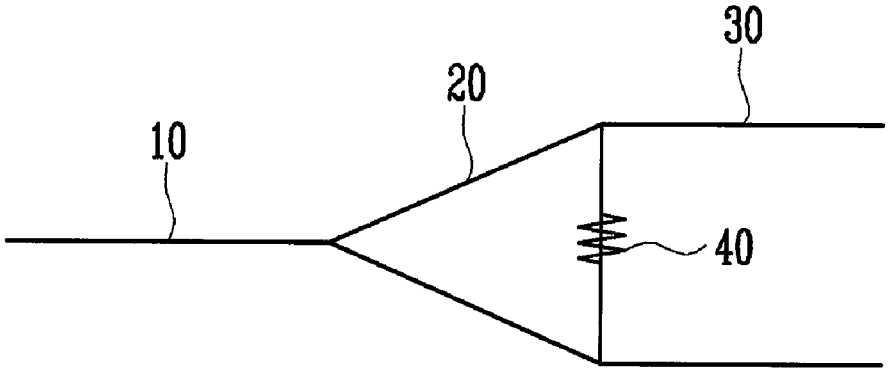
FIG. 3 (PRIOR ART)
FIG. 3 is a circuit diagram illustrating a structure of a typical Wilkinson power divider.
Figure 4:
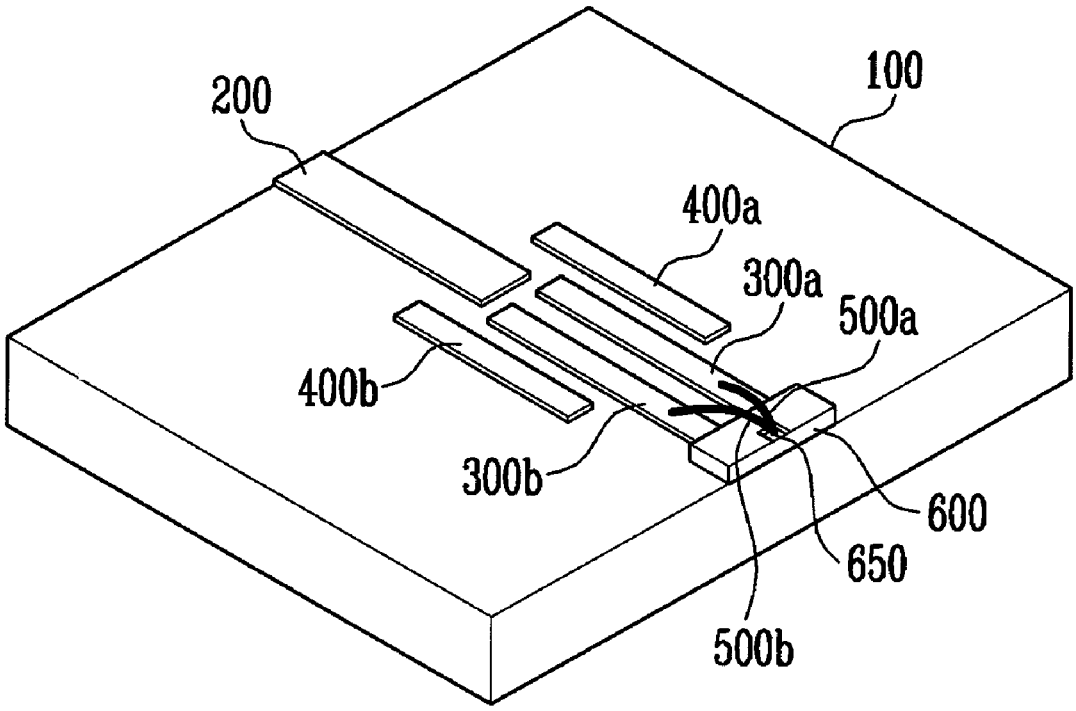
FIG. 4 is a perspective view illustrating a signal transmission line for a millimeter-wave band according to an exemplary embodiment of the present invention.

FIG. 4 is a perspective view illustrating a signal transmission line for a millimeter-wave band according to an exemplary embodiment of the present invention.

Referring to FIG. 4, a signal transmission line for a millimeter-wave band according to an exemplary embodiment of the present invention includes a dielectric substrate 100, an input line 200, a pair of serial transmission lines 300*a* and 300*b*, a pair of parallel transmission lines 400*a* and 400*b*, and a pair of wires 500*a* and 500*b*.

The dielectric substrate 100 may include air or may be in a vacuum state. The dielectric substrate 100 is formed of at least one of a ceramic material, a dielectric material, a magnetic material, and a semiconductor material.

The input line 200 is formed on the dielectric substrate 100, and has good conductivity and an impedance value of 50Ω.

The serial transmission lines 300*a* and 300*b* are formed on the dielectric substrate 100, separated from and parallel to each other. The serial transmission lines 300*a* and 300*b* have an impedance value of 70Ω.

Preferably, one longitudinal end of the input line 200 is spaced apart from yet close enough to be electromagnetically coupled to one longitudinal end of each of the serial transmission lines 300*a* and 300*b*.

In other words, the longitudinal end of the input line 200 is capacitively coupled to the longitudinal end of each of the serial transmission lines 300*a* and 300*b*.

In this manner, the longitudinal end of the input line 200 is branched into two as in a typical Wilkinson power divider and capacitively coupled to the serial transmission lines 300*a* and 300*b*.

The parallel transmission lines 400*a* and 400*b* are formed on the dielectric substrate 100 and have an impedance value of 100Ω.

The transmission lines 400*a* and 400*b* are spaced apart from the input line 200 and the serial transmission lines 300*a* and 300*b* at both longitudinal sides thereof and disposed in parallel with and symmetrical to each other. Preferably, the transmission lines 400*a* and 400*b* are close enough to be electromagnetically coupled to each other.

That is, each of the transmission lines 400*a* and 400*b* is capacitively coupled in parallel with one longitudinal end of the input line 200 and the transmission lines 300*a* and 300*b*.

Preferably, the transmission lines 300*a* and 300*b* and the transmission lines 400*a* and 400*b* differ in width and length to have a resistance characteristic required for transferring a very high frequency signal.

The wires 500*a* and 500*b* are connected between the connection pad 650 of the monolithic microwave integrated circuit (MMIC) 600 mounted on the dielectric substrate 100 and the other longitudinal ends of the serial transmission lines 300*a* and 300*b* by means of typical wire bonding.

Preferably, the input line 200, the serial transmission lines 300*a* and 300*b* and the parallel transmission lines 400*a* and 400*b* according to the exemplary embodiment of the present invention are in the form of a waveguide having a single metal surface.

In the exemplary embodiment of the present invention, the input line 200, the serial transmission lines 300*a* and 300*b* and the parallel transmission lines 400*a* and 400*b* are formed on the dielectric substrate 100, but are not limited thereto. They may be formed in the dielectric substrate 100.

Figure 5:
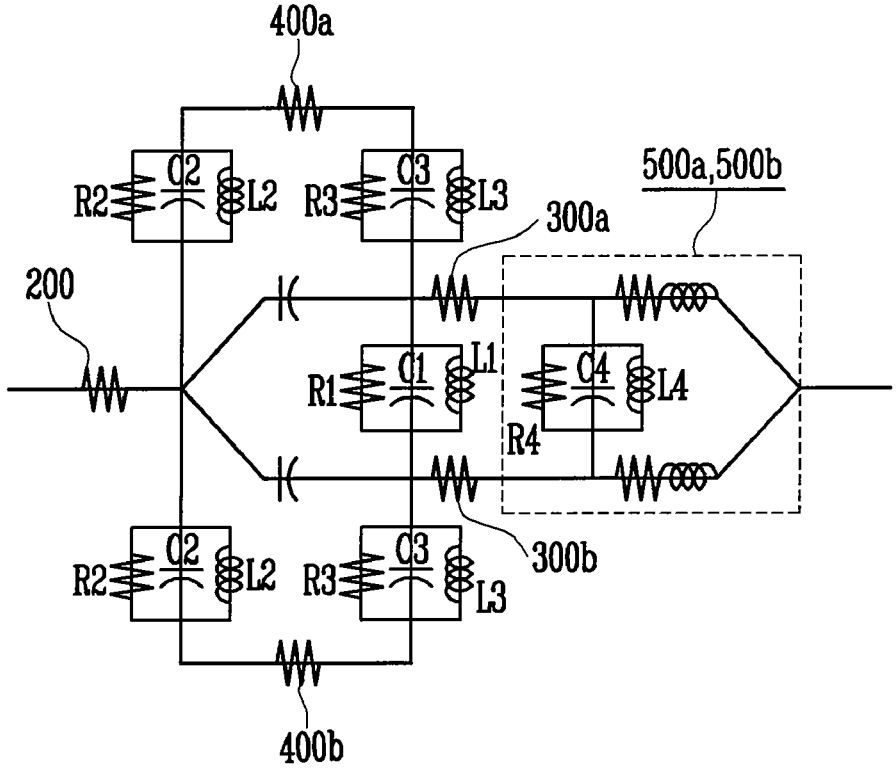
FIG. 5 is an equivalent circuit diagram illustrating a resistance characteristic of a signal transmission line for a millimeter-wave band according to an exemplary embodiment of the present invention.

FIG. 5 is an equivalent circuit diagram illustrating a resistance characteristic of a signal transmission line for a millimeter-wave band according to an exemplary embodiment of the present invention.

Referring to FIG. 5, the signal transmission line in a metal thin film form is a simple input line 200 having an impedance value of 50Ω and is branched into two branches at one end of the input line, resulting in the structure of a typical Wilkinson power divider.

In this case, first branches, i.e., the serial transmission lines 300*a* and 300*b*, have a resistance of 70Ω. An isolation resistor R1, a parasitic capacitor C1, and a parasitic inductor L1 are created between the serial transmission lines 300*a* and 300*b* and have values of 100Ω, 10 pF, and several nH, respectively.

The parasitic capacitor C1 and the parasitic inductor L1 are inevitably in series with and cancelled by compensation capacitors C2 and C3 and compensation inductors L2 and L3 of second branches, i.e., the parallel transmission lines 400*a* and 400*b*, which have a different length and width from the first branches.

The second branches, parallel transmission lines 400*a* and 400*b* and isolation resistors R2 and R3, must be adjusted to a suitable value in consideration of the pair of wires 500*a* and 500*b*. The first and second branches form a resonance circuit at a specific frequency. In order to make the transfer characteristic excellent, the length and width of the branches must be adjusted, i.e., the capacitance and inductance must be added so that a resonance frequency of the resonance circuit becomes a central frequency of the transferred frequencies.

When the branches in a dual waveguide form are employed, dual wiring must be employed to improve the transfer characteristic. When the dual wiring, i.e., the pair of wires 500*a* and 500*b*, is employed an isolation resistor R4 and a parasitic inductor L4 are created. In the case of single wiring, the isolation resistor R4 and the parasitic inductor L4 must be compensated for using a chip or thin film form.

In the case of single wiring, another circuit is necessary and an exact value of wiring is difficult to measure. In an exemplary embodiment of the present invention, this problem is solved by using dual branch extensions, i.e., dual wirings. The isolation resistor R4, the parasitic capacitor C4, and the parasitic inductor L4 cancel the inductor and capacitor of a single wiring.

In the present invention, the resistor, capacitor or inductor may be manufactured in a chip form or in a batch process, and the elements are not limited in material and size.

Figure 6:
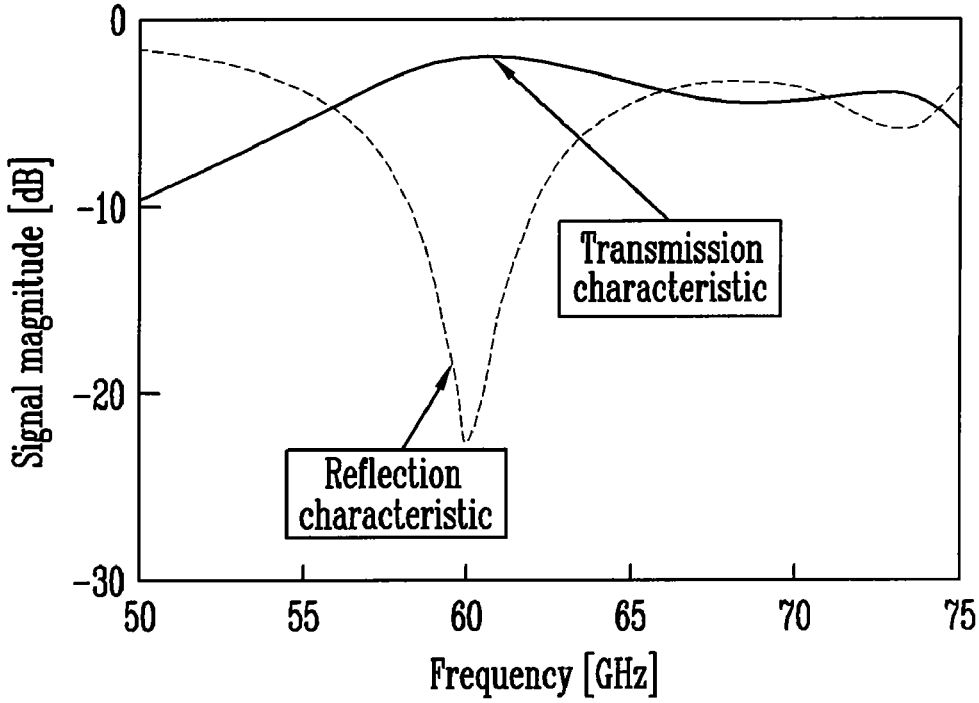
FIG. 6 is a graph showing frequency-dependent reflection and transmission characteristics of a signal transmission line for a millimeter-wave band according to an exemplary embodiment of the present invention.

FIG. 6 is a graph showing frequency-dependent reflection and transmission characteristics of a signal transmission line for a millimeter-wave band according to an exemplary embodiment of the present invention.

Referring to FIG. 6, in the signal transmission line for a millimeter-wave band according to an exemplary embodiment of the present invention, the parasitic components created by the dual branch lines can be cancelled by the compensation capacitor or inductor, thereby improving isolation between the output terminals at very high frequencies and accordingly serving as a narrow-band pass filter having an excellent transfer characteristic in a specific frequency (about 57 to 65 GHz), unlike a conventional power divider. The reflection characteristic has a dip in FIG. 6 as a result of the canceling of the parasitic components using the serial transmission line and the parallel transmission line.

As described above, the signal transmission line for a millimeter-wave band according to the present invention uses the structure of a typical Wilkinson power divider and has a pair of serial or parallel separated transmission lines, creating a combination of serial or parallel compensation capacitances and inductances for effectively canceling unnecessary parasitic components.

In addition, the signal transmission line for a millimeter-wave band includes the dual wires connected to a monolithic microwave integrated circuit (MMIC) for effectively canceling parasitic inductance and parasitic capacitance inevitably created from one of the wires.

Further, the signal transmission line for a millimeter-wave band prevents performance of a power divider from being degraded due to parasitic components such as parasitic inductance and parasitic capacitance in a conventional Wilkinson power divider, and has an excellent transfer characteristic at a specific frequency (about 57 to 65 GHz).

Furthermore, the signal transmission line in a metal thin film form is manufactured in a dual parallel waveguide form based on the structure of the Wilkinson power divider. Thus, an operation frequency increases from a MHz band to a GHz or THz band, thereby improving electric-signal transfer performance.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A signal transmission line for a millimeter-wave band, comprising:

a dielectric substrate;

an input line disposed on the dielectric substrate, the input line having a first end and a second end along a first direction, the input line being configured to receive a millimeter-wave signal at the first end and output the millimeter-wave signal at the second end;

a first serial transmission line disposed on the dielectric substrate and spaced apart from the second end of the input line along the first direction, the first serial transmission line being sufficiently close to the second end of the input line to be electromagnetically coupled in series to the second end of the input line;

a second serial transmission line disposed on the dielectric substrate and spaced apart from the second end of the input line along the first direction, the second serial transmission line being sufficiently close to the second end of the input line to be electromagnetically coupled in series to the second end of the input line, the second serial transmission line being spaced apart from the first serial transmission line along a second direction that is orthogonal to the first direction;

a first parallel transmission line disposed on the dielectric substrate and spaced apart from the second end of the input line and the first serial transmission line along the second direction, the first parallel transmission line being sufficiently close to the second end of the input line and the first serial transmission line to be electromagnetically coupled to the second end of the input line and the first serial transmission line;

a second parallel transmission line formed on the dielectric substrate and spaced apart from the second end of the input line and the second serial transmission line along the second direction, the second parallel transmission line being sufficiently close to the second end of the input line and the second serial transmission line to be electromagnetically coupled to the second end of the input line and the second serial transmission line;

a first wire connecting the first serial transmission line to a connection pad of a monolithic microwave integrated circuit (MMIC); and a second wire connecting the second serial transmission line to the connection pad of the MMIC.

2. The signal transmission line according to claim 1, wherein the dielectric substrate comprises a ceramic material, a dielectric material, a magnetic material, a semiconductor material, or a combination thereof.

3. The signal transmission line according to claim 1, wherein the first and second serial transmission lines are configured to received a millimeter-wave signal from the input line and output the millimeter-wave signal to the connection pad of the MMIC, the first and second serial transmission lines being spaced apart from each other and extending parallel to each other.

4. The signal transmission line according to claim 1, wherein the first and second parallel transmission lines are electromagnetically coupled to the input line and the first and second serial transmission lines without being electrically connected to the input line and the first and second serial transmission lines.

5. The signal transmission line according to claim 1, wherein the serial transmission lines and the parallel transmission lines differ in width and length.

6. The signal transmission line according to claim 1, wherein the input line, the first and second serial transmission lines, and the first and second parallel transmission lines are in the form of a waveguide.

7. The signal transmission line according to claim 1, wherein the input line has impedance of 50Ω, the first and second serial transmission lines each has impedance of 70Ω, and the first and second parallel transmission lines each has impedance of 100Ω.

8. The signal transmission line of claim 1, wherein the first and second serial transmission lines and the first and second parallel transmission lines form a resonant circuit.

9. The signal transmission line of claim 1, wherein the signal transmission line is configured to transmit a signal having a frequency of 57-65 GHz.

10. The signal transmission line of claim 1, wherein the first and second parallel transmission lines are not electrically connected to the connection pad of the MMIC.

11. The signal transmission line of claim 1, wherein the first and second parallel transmission lines are configured to substantially cancel out first parasitic capacitance or first inductance, or both, associated with the first and second serial transmission lines.

* * * * *